US007901112B2

(12) United States Patent
Chen

(10) Patent No.: US 7,901,112 B2
(45) Date of Patent: Mar. 8, 2011

(54) LAP BASED IN LIGHT-EMITTING DIODES

(76) Inventor: Chia-Yi Chen, Pingtung County (TW)

( * ) Notice: Subject to any disclaimer, the term of this patent is extended or adjusted under 35 U.S.C. 154(b) by 246 days.

(21) Appl. No.: 12/229,884

(22) Filed: Aug. 27, 2008

(65) Prior Publication Data

US 2010/0053977 A1 Mar. 4, 2010

(51) Int. Cl.
*F21V 7/00* (2006.01)
*F21V 7/04* (2006.01)

(52) U.S. Cl. ..... 362/310; 362/249.02; 362/555; 362/294; 362/255; 362/256

(58) Field of Classification Search ..... 362/249.02, 362/255, 256, 294, 310, 555
See application file for complete search history.

(56) References Cited

U.S. PATENT DOCUMENTS 6,936,968 B2 * 8/2005 Cross et al. ..... 315/74
7,478,936 B2 * 1/2009 Chen ..... 362/555
7,670,028 B2 * 3/2010 Liu et al. ..... 362/294
7,670,040 B2 * 3/2010 Park ..... 362/612
7,712,918 B2 * 5/2010 Siemiet et al. ..... 362/241
2009/0154167 A1 * 6/2009 Lin ..... 362/294
2009/0316385 A1 * 12/2009 Weber et al. ..... 362/92

* cited by examiner

*Primary Examiner* — Stephen F Husar
*Assistant Examiner* — James W Cranson
(74) *Attorney, Agent, or Firm* — Charles E. Baxley

(57) ABSTRACT

A lamp includes a tube, a reflector, at least one illuminator unit, at least one radiator and two connectors. The tube is made of a transparent material. A reflector is disposed in the tube. The illuminator unit includes at least one light-emitting diode for emitting light. The radiator includes a first reduced portion inserted in the tube, a second reduced portion located opposite to the first reduced portion and fins for dissipating heat generated by the light-emitting diode. The first reduced portion of the radiator is formed with a face for supporting the illuminator unit so that the light-emitting diode can cast the light to the reflector that can reflect the light. The connectors are connected to the illuminator unit for conducting electricity to the illuminator unit from a power supply.

6 Claims, 7 Drawing Sheets

LAP BASED IN LIGHT-EMITTING DIODES

FIELD OF INVENTION

The present invention relates to a lamp based on at least one light-emitting diode.

BACKGROUND OF INVENTION

Fluorescent lamps are common. A fluorescent lamp is substantially a gas discharge tube with a fluorescent material coated on an internal side thereof and argon filled therein. Neon or krypton may additionally be filled in the fluorescent lamp. The pressure in the fluorescent lamp is about 0.3% of that in the atmosphere. A small amount of mercury is filled in the fluorescent lamp to provide silver vapor. The amount of the silver atoms is about 1/1000 of that of all gas atoms. Electricity is directed through the fluorescent lamp to cause gas discharge. The gas discharge causes the mercury vapor to emit ultraviolet light with average wavelength of 2534 angstroms. About 60% of the electricity is converted to the ultraviolet light. The other electricity is converted to heat that is dissipated. The fluorescent material converts about 40% of the ultraviolet light to visible light. Therefore, the efficiency of the fluorescent lamp is about 24% (60%×40%), roughly twice as high as that of a typical tungsten light bulb.

As discussed above, the efficiency of a fluorescent lamp is low, and the life of a fluorescent lamp is short. As energy is running out while pollution is getting worse, it is important to increase the efficiencies and lives of devices as well as exploit so called "green" energy. There is a trend to use light-emitting diodes instead of the fluorescent lamps because the light-emitting diodes consume less energy, last longer, work more stably and efficiently than the fluorescent lamps.

However, a light-emitting diode generates a lot of heat while emitting light. A light-emitting diode will have to operate at a high temperature for a long time if it is used instead of a fluorescent lamp. The quality of the light-emitting diode will deteriorate so that the life will be reduced. Moreover, the efficiency of the light-emitting diode will drop so that the luminance will be reduced. Light-emitting diodes will be more popular if the problems associated with the heat are solved.

In a lamp, light-emitting diodes are provided in a tube with a rough internal side for scatter light emitted from the light-emitting diodes. The efficiency of this lamp is low.

In another lamp, light-emitting diodes and radiators are provided in a tube so that the radiators dissipate heat generated with the light-emitting diodes. The large amount of the light-emitting diodes however entails a high cost in manufacturing and a high cost in operation.

The present invention is therefore intended to obviate or at least alleviate the problems encountered in prior art.

SUMMARY OF INVENTION

It is an objective of the present invention to provide an inexpensive lamp.

It is another objective of the present invention to provide an efficient lamp.

It is still another objective of the present invention to provide a durable lamp.

According to the present invention, the lamp includes a tube, a reflector, at least one illuminator unit, at least one radiator and two connectors. The tube is made of a transparent material. A reflector is disposed in the tube. The illuminator unit includes at least one light-emitting diode for emitting light. The radiator includes a first reduced portion inserted in the tube, a second reduced portion located opposite to the first reduced portion and fins for dissipating heat generated by the light-emitting diode. The first reduced portion of the radiator is formed with a face for supporting the illuminator unit so that the light-emitting diode can cast the light to the reflector that can reflect the light. The connectors are connected to the illuminator unit for conducting electricity to the illuminator unit from a power supply.

Other objectives, advantages and features of the present invention will become apparent from the following description referring to the attached drawings.

BRIEF DESCRIPTION OF DRAWINGS

The present invention will be described via the detailed illustration of the preferred embodiment referring to the drawings.

DETAILED DESCRIPTION OF PREFERRED EMBODIMENT

Figure 1:
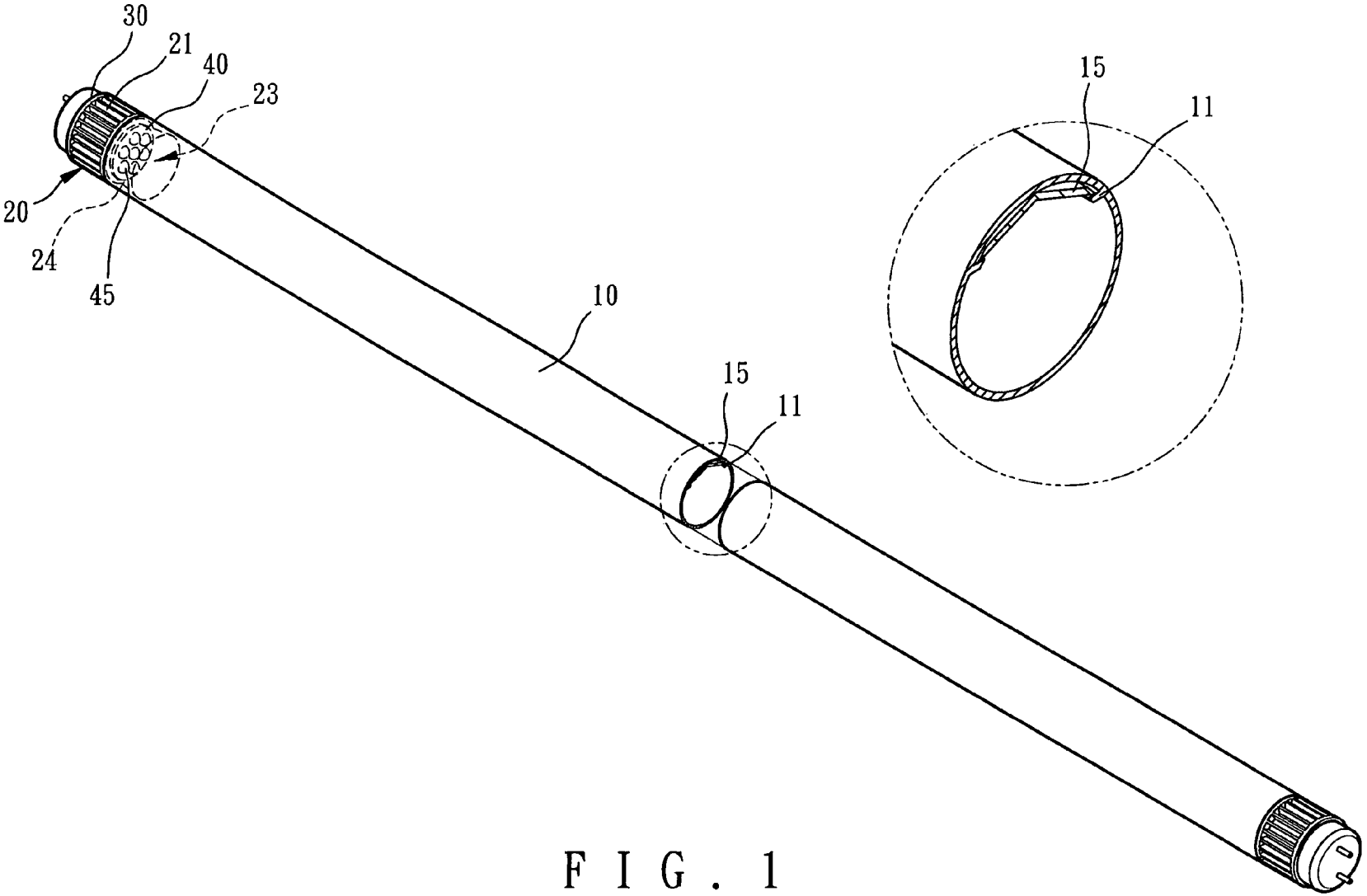
FIG. 1 is a perspective view of a lamp according to the preferred embodiment of the present invention.
Figure 2:
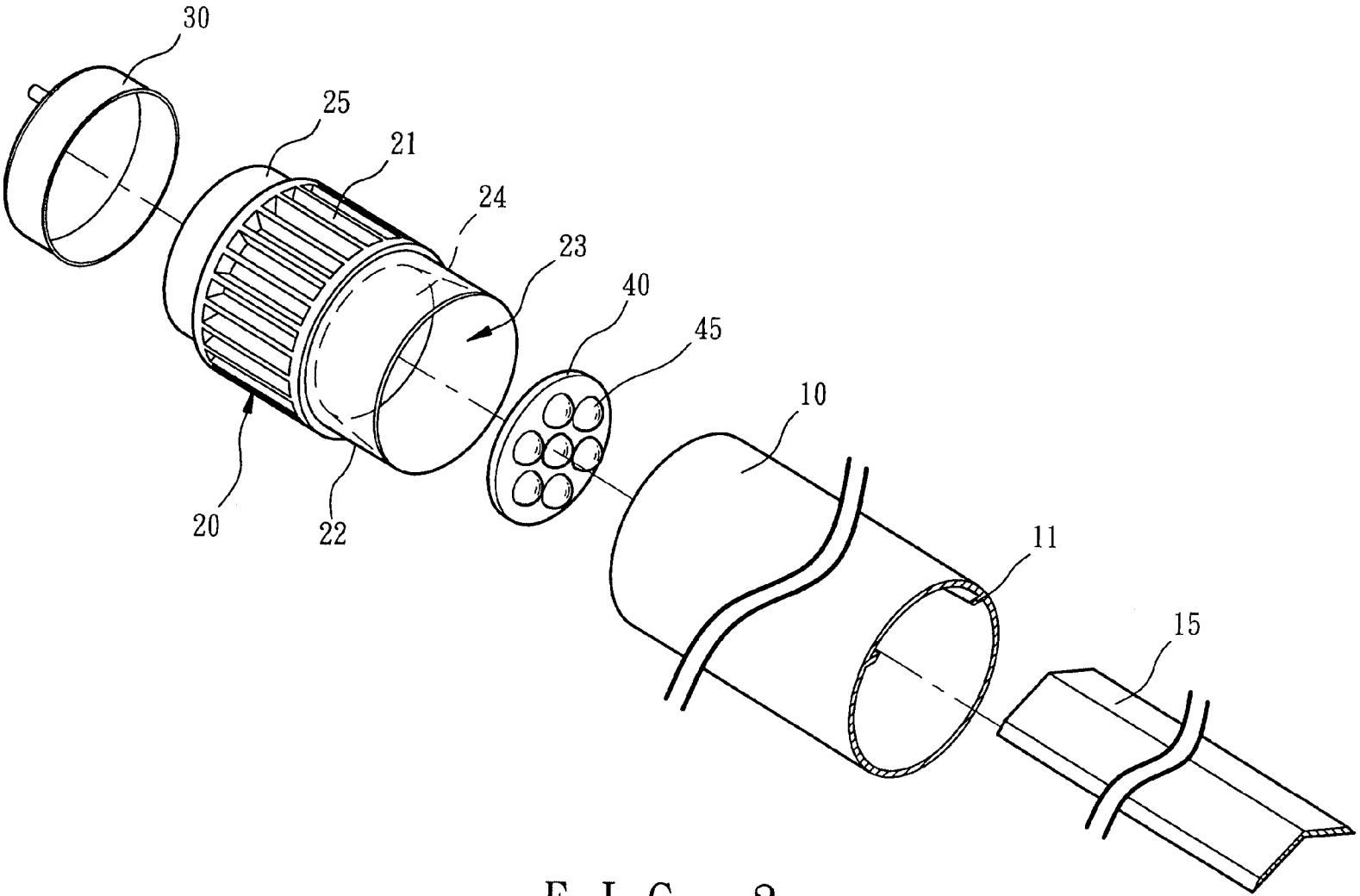
FIG. 2 is an exploded view of the lamp shown in FIG. 1.
Figure 3:
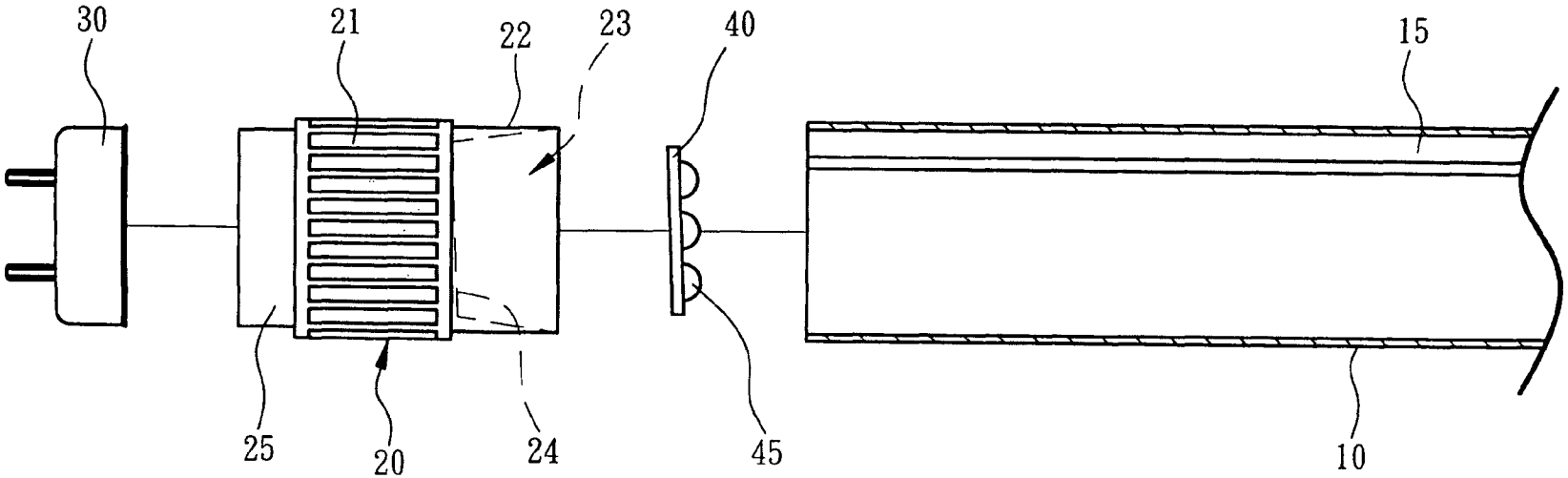
FIG. 3 is an enlarged partial side view of the lamp shown in FIG. 2.
Figure 4:
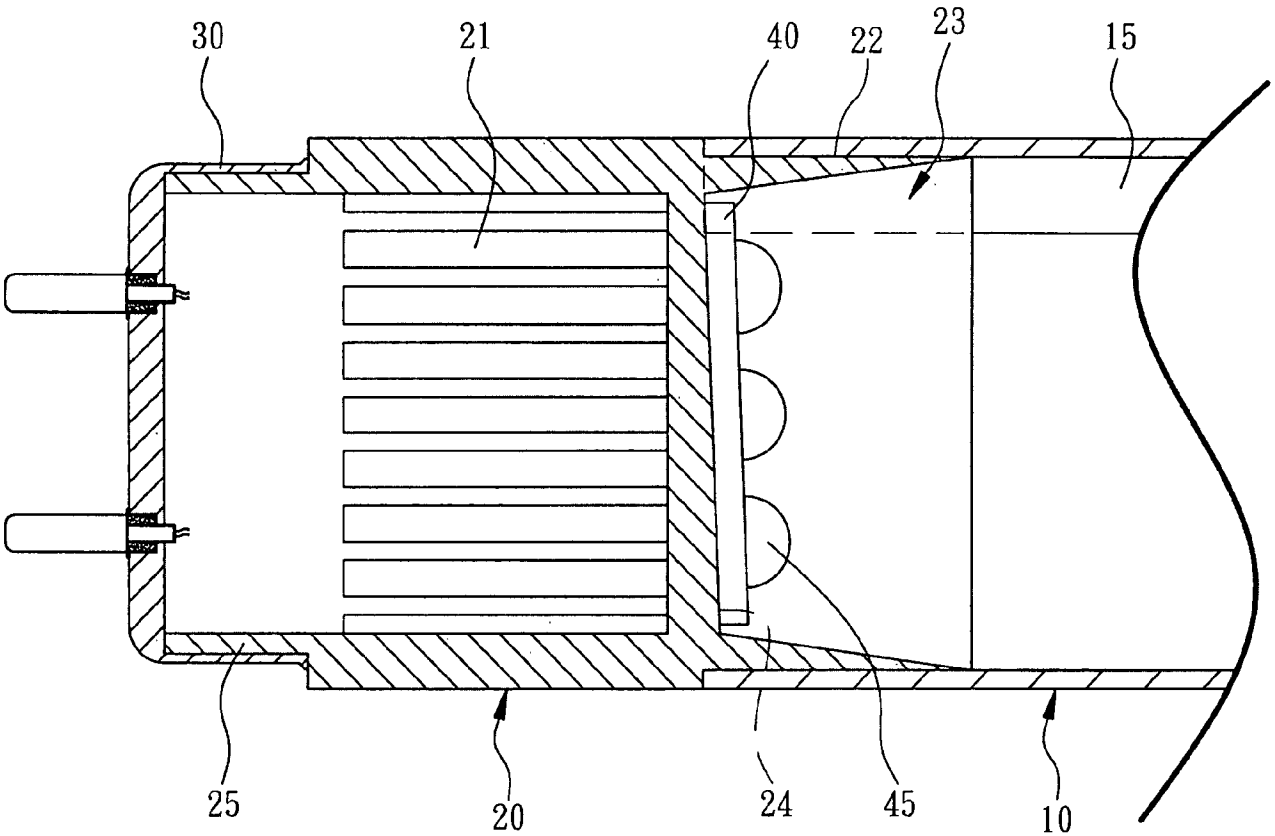
FIG. 4 is an enlarged partial cross-sectional view of the lamp shown in FIG. 3.
Figure 5:
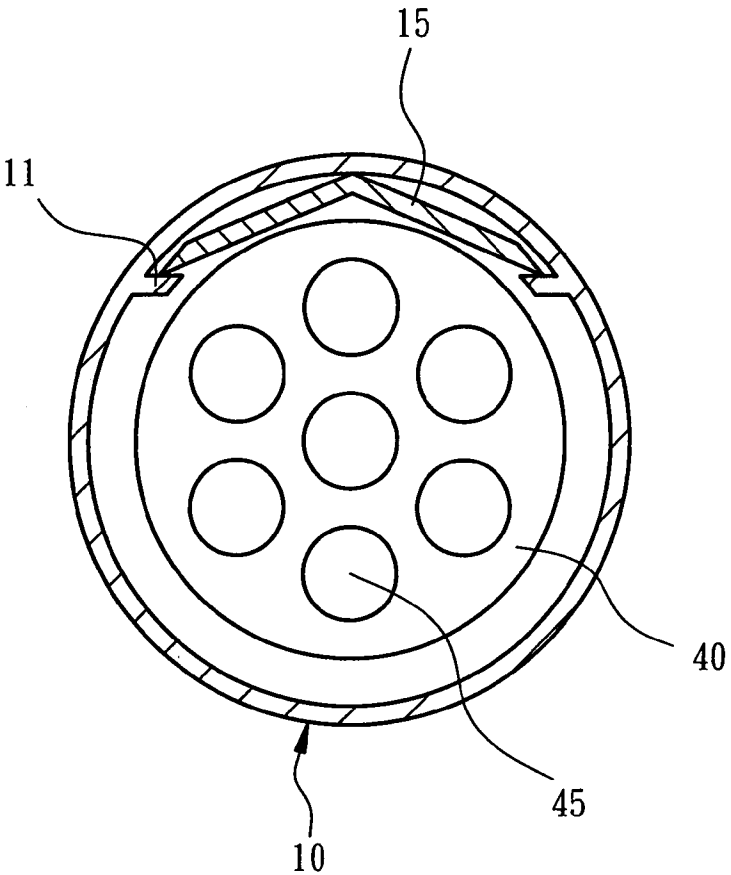
FIG. 5 is another cross-sectional view of the lamp shown in FIG. 4.

Referring to FIGS. 1 through 3, a lamp include a tube 10, two radiators 20, two electric connectors 30 and two illuminator units 40 according to the preferred embodiment of the present invention. The tube 10 is made of a transparent material such as glass and acrylic. Referring to FIGS. 4 and 5, two ribs 11 are formed on an internal side of the tube 10 and a reflector 15 supported on the ribs 11. The reflector 15 includes a bent form as particularly shown in FIG. 5. The reflector 15 may include an arched form in another embodiment. Furthermore, the reflector 15 may be replaced with a reflector coating on the internal side of the tube 10 and the ribs 11 be omitted in another embodiment.

The radiators 20 are made of a radiating material such as aluminum. Each of the radiators 20 includes fins 21 formed on an external side, i.e., the periphery. The fins 21 are used to dissipate heat generated by the illuminator units 40 to the environment. Each of the radiators 20 includes a first reduced portion 22 formed at an end, a second reduced portion 25 formed at an opposite end and a cavity 23 defined in the first reduced portion 22. The first reduced portion 22 is inserted in a related end of the tube 10. The second reduced portion 25 is inserted in a related one of the connectors 30.

The cavity 23 is defined by a planar face 24 and a conical face. If the tube 10 is laid horizontally, the axis of the conical face will be located horizontally while a line perpendicular to the planar face 24 is biased upwards from a horizontal line.

Each of the illuminator units 40 includes light-emitting diodes 45 provided on a circuit board. The circuit board is attached to the planar face 24 of a related one of the radiators 20.

Each of the connectors 30 is connected to a related one of the illuminator units 40. The connectors 30 can be connected to a power supply for energizing the illuminator units 40 with the power supply.

Figure 6:
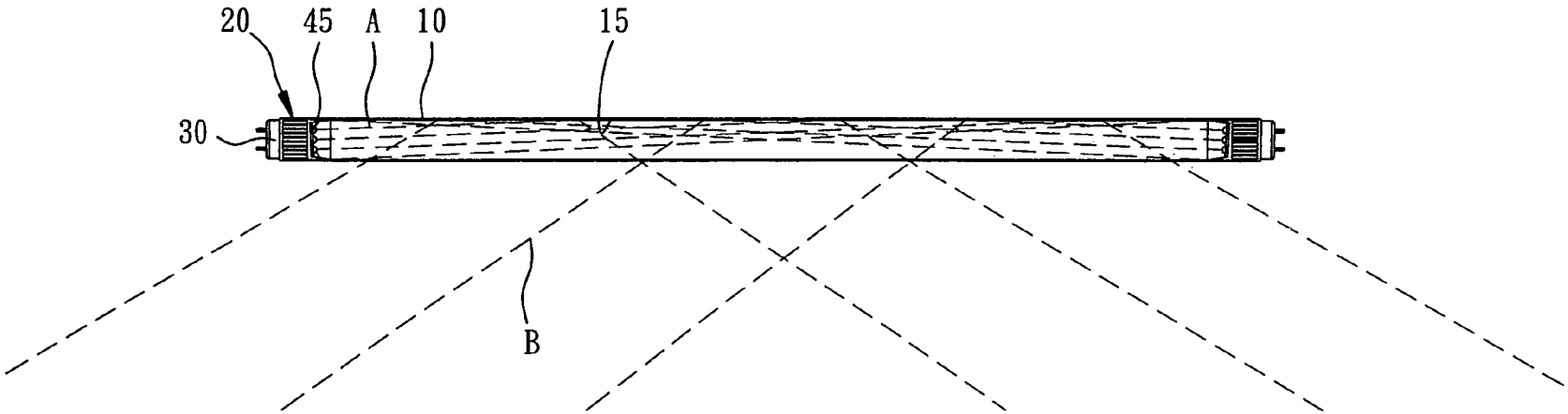
FIG. 6 is side view of the lamp shown in FIG. 1.
Figure 7:
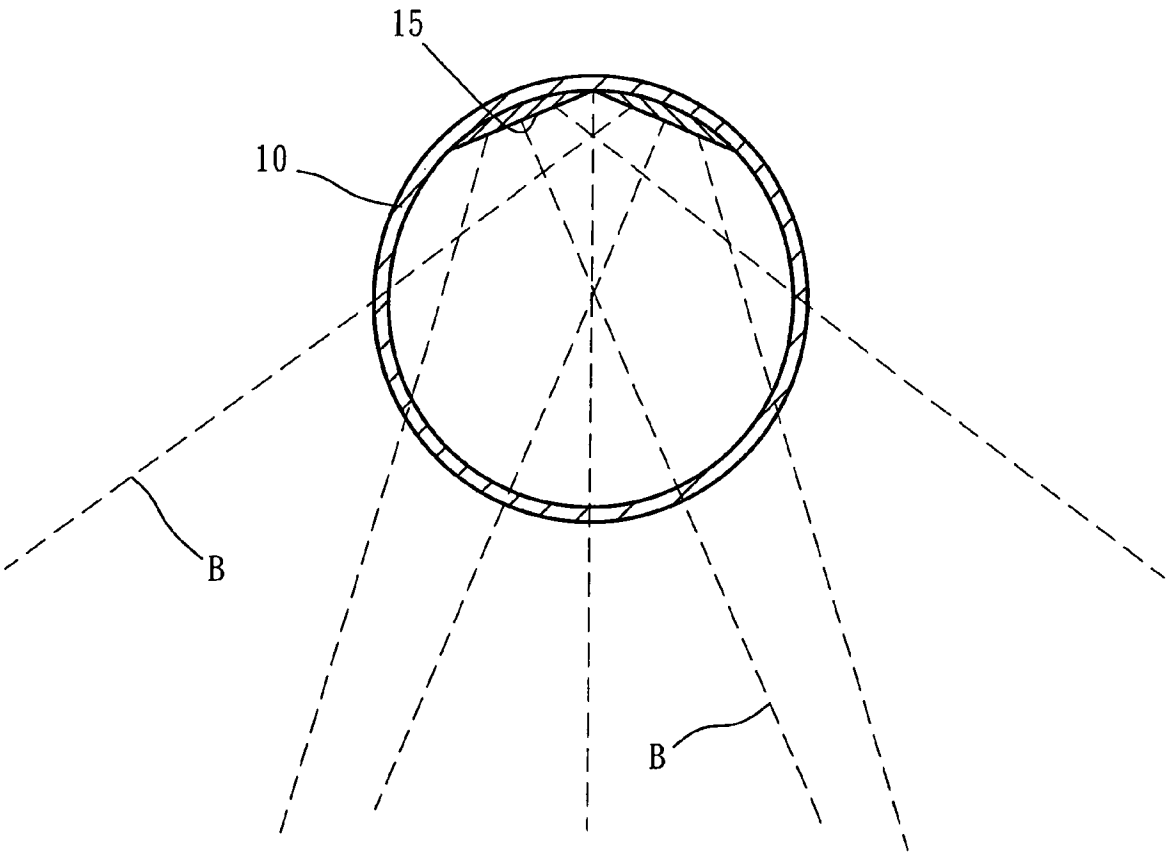
FIG. 7 is an enlarged cross-sectional view of the lamp of FIG. 6.

Referring to FIGS. 6 and 7, the light-emitting diodes 45 emits light towards the reflector 15 as indicated with a letter "A." In turn, the reflector 15 reflects and scatters the light as indicated with a letter "B." Thus, the light is used for illumination.

There are advantages of the lamp of the present invention over the lamps addressed in the BACKGROUND OF INVENTION. Firstly, the cost is low in the fabrication of the lamp because there are only a few light-emitting diodes 45. Secondly, the efficiency of the operation of the lamp is constant because the radiators 20 prevent heat from accumulating in the lamp. Thirdly, the life of the lamp is long because overheating of the lamp is prevented.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A lamp comprising:

a tube made of a transparent material;

a reflector disposed in the tube;

at least one illuminator unit comprising at least one light-emitting diode for emitting light;

at least one radiator comprising a first reduced portion inserted in the tube and formed with a face for supporting the illuminator unit so that the light-emitting diode can cast the light to the reflector that can reflect the light, a second reduced portion located opposite to the first reduced portion and fins for dissipating heat generated by the light-emitting diode; and two connectors connected to the illuminator unit for conducting electricity to the illuminator unit from a power supply.

2. The lamp according to claim 1, wherein the transparent material is selected from a group consisting of glass and acrylic.

3. The lamp according to claim 1, wherein the reflector is made with a bent form.

4. The lamp according to claim 1, wherein the tube comprises two ribs formed on an internal side thereof for supporting the reflector.

5. The lamp according to claim 1, wherein the radiator is made of aluminum.

6. The lamp according to claim 1, wherein the first reduced portion of the radiator comprises a cavity for receiving the illuminator unit.

* * * * *